US007272950B1

(12) United States Patent
Roman

(10) Patent No.: US 7,272,950 B1
(45) Date of Patent: Sep. 25, 2007

(54) NOVELTY ENCLOSURE FOR TRAPPING DRY ICE IN A DRINKING GLASS

(76) Inventor: Jonathan Roman, 743 40th Ave., San Francisco, CA (US) 94121

( * ) Notice: Subject to any disclaimer, the term of this patent is extended or adjusted under 35 U.S.C. 154(b) by 195 days.

(21) Appl. No.: 11/214,338

(22) Filed: Aug. 29, 2005

(51) Int. Cl.
*F25D 3/12* (2006.01)
*F25D 3/08* (2006.01)

(52) U.S. Cl. ..... 62/384; 62/457.3

(58) Field of Classification Search ..... 62/384, 62/388, 463, 457.2, 457.3, 459, 457.4, 462, 62/464; 220/592.17
See application file for complete search history.

(56) References Cited

U.S. PATENT DOCUMENTS 4,096,707 A * 6/1978 Taylor ..... 62/167
4,405,348 A * 9/1983 Pasternack ..... 62/259.3
4,938,375 A 7/1990 Fantacone
5,727,712 A * 3/1998 Costello ..... 220/703
5,775,534 A 7/1998 Webb et al.
5,860,558 A * 1/1999 Fahy ..... 220/719
5,913,964 A * 6/1999 Melton ..... 99/322
5,971,202 A * 10/1999 Filbrun ..... 220/719
6,101,838 A * 8/2000 Teague ..... 62/457.4
6,227,004 B1 * 5/2001 Gerstein ..... 62/421
6,269,651 B1 * 8/2001 Price ..... 62/255
6,378,325 B1 * 4/2002 Yang ..... 62/457.6
6,474,096 B1 * 11/2002 de la Guardia ..... 62/457.3
6,557,351 B1 * 5/2003 Ghedini et al. ..... 62/1
6,868,694 B2 * 3/2005 Nielsen ..... 62/457.3
2004/0035144 A1 2/2004 Nielsen

FOREIGN PATENT DOCUMENTS

JP 2000-65453 A * 3/2000

* cited by examiner

*Primary Examiner*—Mohammad M. Ali
(74) *Attorney, Agent, or Firm*—Bernard S. Hoffman

(57) ABSTRACT

A novelty enclosure for trapping dry ice in a drinking glass. The novelty enclosure includes a fixed portion, a replaceable portion, and apparatus. The fixed portion is positioned within—and is attached to—the bowl of the drinking glass, and traps the dry ice. The replaceable portion is replaceably attached to the fixed portion allowing the fixed portion to be filled with the dry ice. The apparatus allows the fixed portion and/or the replaceable portion to permit vapor from the dry ice to rise there through and up through and out of the drink giving an illusion of a witches brew.

21 Claims, 12 Drawing Sheets

NOVELTY ENCLOSURE FOR TRAPPING DRY ICE IN A DRINKING GLASS

1. BACKGROUND OF THE INVENTION

A. Field of the Invention

The present invention relates to an enclosure for trapping dry ice, and more particularly, the present invention relates to a novelty enclosure for trapping dry ice in a drinking glass.

B. Description of the Prior Art

Dry ice—solidified $CO_2$—is commonly available in block form and pellets in many grocery stores, as well as other locations. It is commonly used in shipping perishable items and for cooling beverages. Because dry ice changes state directly to a gas—instead of first to a liquid as does regular ice—when used to cool beverages it does not dilute.

Numerous innovations for drinking vessels have been provided in the prior art that will be described infra. Even though these innovations may be suitable for the specific individual purposes to which they address, however, they differ from the present invention in that they do not teach a novelty enclosure for trapping dry ice in a drinking glass.

(1) U.S. Pat. No. 4,938,375 to Fantacone.

For example, U.S. Pat. No. 4,938,375 issued to Fantacone on Jul. 3, 1990 teaches an ice trap including a trapping device and beverage cup combination. The trapping device has a plurality of openings, a conical shaped side section, a rim, a compression gap, and compressing tabs for inserting, locking in, and removing the trapping device. The trapping device also has a bottom section with a downward pitch for ice containment near the inner cup wall when tilted, and, a center bottom opening in the bottom section for inserting a straw. The beverage cup has an internal annular lip formed from the inwardly sloping wall, and, an annular horizontal bottom surface included beneath the lip for locking the trapping device in place.

(2) U.S. Pat. No. 5,775,534 to Webb et al.

Another example, U.S. Pat. No. 5,775,534 issued to Webb et al. on Jul. 7, 1998 teaches a beverage container in the form of an aluminum can having a top plate in which a dispensing aperture is formed by pulling a tab so as to inwardly displace a tongue portion. Filtering apparatus is resiliently mounted within the container so as to be deployed at a location traversing the dispensing aperture after the tongue portion has been inwardly displaced. The filtering apparatus may be a perforate plate and may have perforations defining a competition visual indication whereby the token becomes visible only after the container is opened.

(3) U.S. Patent Application Publication No. 2004/0035144 to Nielsen.

Still another example, U.S. Patent Application Publication No. 2004/0035144 published to Nielsen on Feb. 26, 2004 teaches a drinking vessel including an interior portion holding pellets or chips of dry ice that cool a beverage in the glass while the beverage is being consumed. The interior portion can be a part of the glass or it can be a detached piece usable in different vessels. Either way the interior portion includes holes that allow the beverage to freely flow around the dry ice, while the holes are small enough to prevent the dry ice from entering the portion of the vessel where it could be accidentally consumed.

It is apparent that numerous innovations for drinking vessels have been provided in the prior art that are adapted to be used. Furthermore, even though these innovations may be suitable for the specific individual purposes to which they address, however, they would not be suitable for the purposes of the present invention as heretofore described, namely, a novelty enclosure for trapping dry ice in a drinking glass.

2. SUMMARY OF THE INVENTION

Accordingly, an object of the present invention is to provide a novelty enclosure for trapping dry ice in a drinking glass that avoids the disadvantages of the prior art.

Briefly stated, another object of the present invention is to provide a novelty enclosure for trapping dry ice in a drinking glass. The novelty enclosure includes a fixed portion, a replaceable portion, and apparatus. The fixed portion is positioned within—and is attached to—the bowl of the drinking glass, and traps the dry ice. The replaceable portion is replaceably attached to the fixed portion allowing the fixed portion to be filled with the dry ice. The apparatus allows the fixed portion and/or the replaceable portion to permit vapor from the dry ice to rise there through and up through and out of the drink giving an illusion of a witches brew.

The novel features that are considered characteristic of the present invention are set forth in the appended claims. The invention itself, both as to its construction and its method of operation, together with additional objects and advantages thereof, will be best understood from the following description of the specific embodiments when read and understood in connection with the accompanying drawing.

3. BRIEF DESCRIPTION OF THE DRAWING

The figures of the drawing are briefly described as follows.

4. LIST OF REFERENCE NUMERALS UTILIZED IN THE DRAWING

A. General

Figure 1:
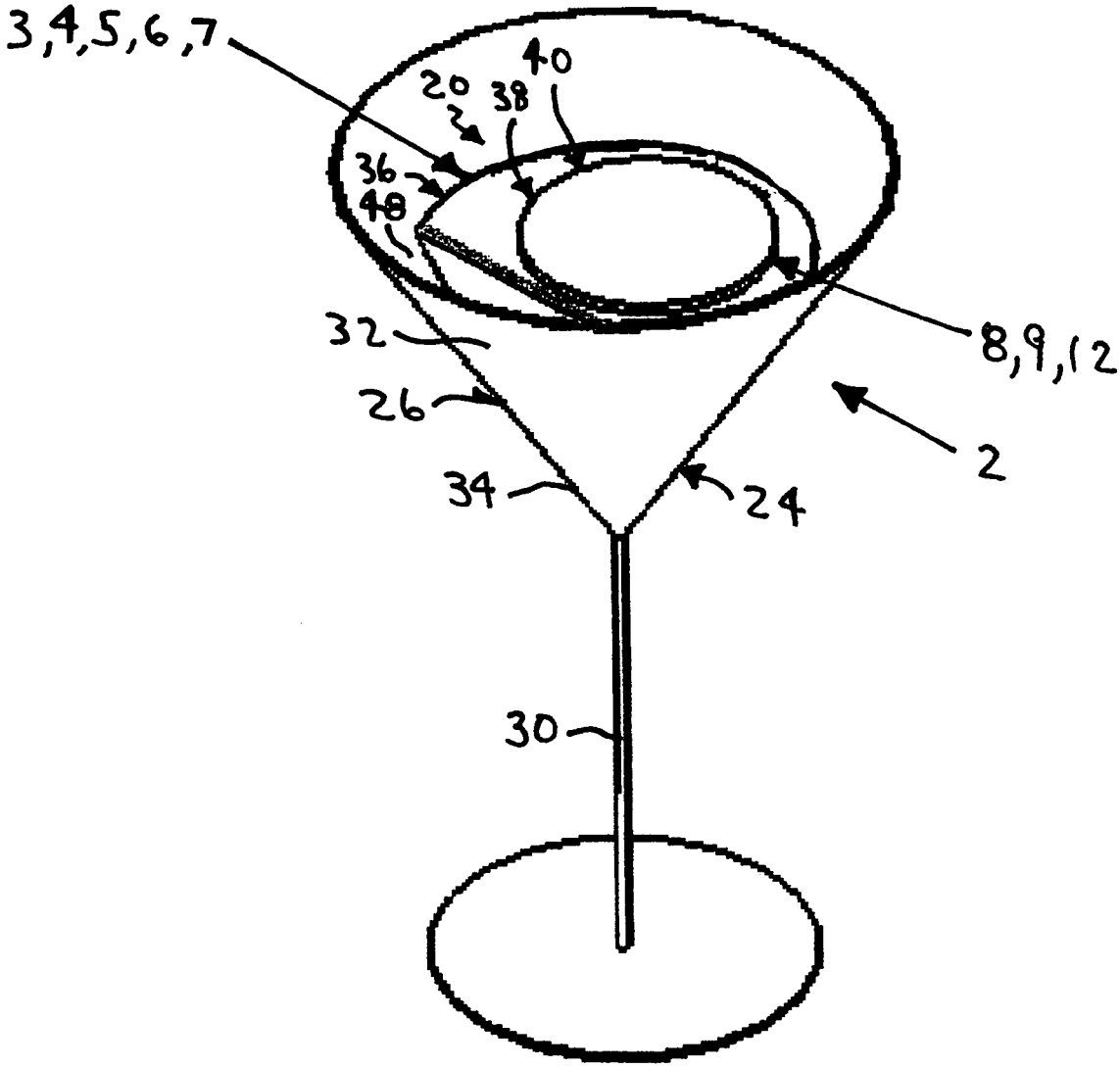
FIG. 1 is a diagrammatic perspective view of the novelty enclosure of the present invention trapping dry ice in a drinking glass.

20 novelty enclosure of present invention for trapping dry ice 22 in drinking glass 24

22 dry ice

24 drinking glass

26 bowl of drinking glass 24 for containing drink 28

28 drink

30 optional stem of drinking glass 24

32 side wall of bowl 26 of drinking glass 24

34 bottom of bowl 26 of drinking glass 24

36 fixed portion for positioning within—and attaching to—bowl 26 of drinking glass 24, and for trapping dry ice 22

38 replaceable portion for allowing fixed portion 36 to be filled with dry ice 22

40 apparatus for allowing at least one of fixed portion 36 and replaceable portion 38 to permit vapor 42 from dry ice 22 to rise there through and up through and out of drink 28 giving illusion of witches brew

42 vapor from dry ice 22

44 top part of fixed portion 36 for extending transversely across side wall 32 of bowl 26 of drinking glass 24

46 side part of fixed portion 36 for extending laterally across side wall 32 of bowl 26 of drinking glass 24 and downwardly to bottom 34 of bowl 26 of drinking glass 24—and in doing so—together with top part 44 of fixed portion 36—traps dry ice 22 to one side of side part 46 of fixed portion 36 without obstructing bowl 26 of drinking glass 24 to other side of side part 46 of fixed portion 36 so as to provide unobstructed portion 48 in bowl 26 of drinking glass 24—opposite to top part 44 of fixed portion 36—for placement of, for example, straw 50, toothpick/olive, etc.

48 unobstructed portion in bowl 26 of drinking glass 24

50 straw

52 periphery of top part 44 of fixed portion 36

54 outer portion of periphery 52 of top part 44 of fixed portion 36 for contacting side wall 32 of bowl 26 of drinking glass 24

56 inner portion of periphery 52 of top part 44 of fixed portion 36 for being spaced from side wall 32 of bowl 26 of drinking glass 24 so as to provide unobstructed portion 48 in bowl 26 of drinking glass 24

58 through bore in top part 44 of fixed portion 36 for allowing fixed portion 36 to be filled with dry ice 22

60 periphery of through bore 58 in top part 44 of fixed portion 36

B. First Embodiment of Apparatus

140 apparatus

C. Second Embodiment of Apparatus

240 apparatus

262 plurality of through bores in top part 44 of fixed portion 36 of apparatus 240

D. Third Embodiment of Apparatus

340 apparatus

364 recess in outer portion 54 of periphery 52 of top part 44 of fixed portion 36 of apparatus 340 for providing space 368 between outer portion 54 of periphery 52 of top part 44 of fixed portion 36 and side wall 32 of bowl 26 of drinking glass 24

366 depending tab in recess 364 in outer portion 54 of periphery 52 of top part 44 of fixed portion 36 of apparatus 340

368 space formed by recess 364 in outer portion 54 of periphery 52 of top part 44 of fixed portion 36 of apparatus 340 for allowing vapor 42 from dry ice 22 to rise there through and up through and out of drink 28 giving illusion of witches brew, and for drainage of debris contained in fixed portion 36.

E. Fourth Embodiment of Apparatus

440 apparatus

464 recess in periphery 60 of through bore 58 in top part 44 of fixed portion 36 of apparatus 440

468 space formed by recess 464 in periphery 60 of through bore 58 in top part 44 of fixed portion 36 of apparatus 440 for allowing vapor 42 from dry ice 22 to rise there through and up through and out of drink 28 giving an illusion of witches brew, and for prying out of removable portion 38

F. Fifth Embodiment of Apparatus

540 apparatus

570 plurality of tabs of outer portion 54 of periphery 52 of top part 44 of fixed portion 36 of apparatus 540 for attaching to bowl 26 of drinking glass 24

572 plurality of spaces formed by plurality of tabs 570 of outer portion 54 of periphery 52 of top part 44 of fixed portion 36 of apparatus 540 for allowing vapor 42 from dry ice 22 to rise there through and up through and out of drink 28 giving illusion of witches brew

G. Sixth Embodiment of Apparatus

640 apparatus

662 plurality of through bores in replaceable portion 38 of apparatus 640 for allowing vapor 42 from dry ice 22 to rise there through and up through and out of drink 28 giving illusion of witches brew

H. First Embodiment of Replaceable Portion

138 replaceable portion

174 cap of replaceable portion 138 for preventing dry ice 22 from spilling out of fixed portion 36 and being consumed

176 body of cap 174 of replaceable portion 138 for allowing vapor 42 from dry ice 22 to rise there between and up through and out of drink 28 giving illusion of witches brew

178 upper flange of cap 174 of replaceable portion 138

I. Second Embodiment of Replaceable Portion

238 replaceable portion

274 cap of replaceable portion 238

276 body of cap 274 of replaceable portion 238

278 upper flange of cap 274 of replaceable portion 238

280 lower flange of cap 274 of replaceable portion 238

5. DETAILED DESCRIPTION OF THE INVENTION

A. General

Figure 2:
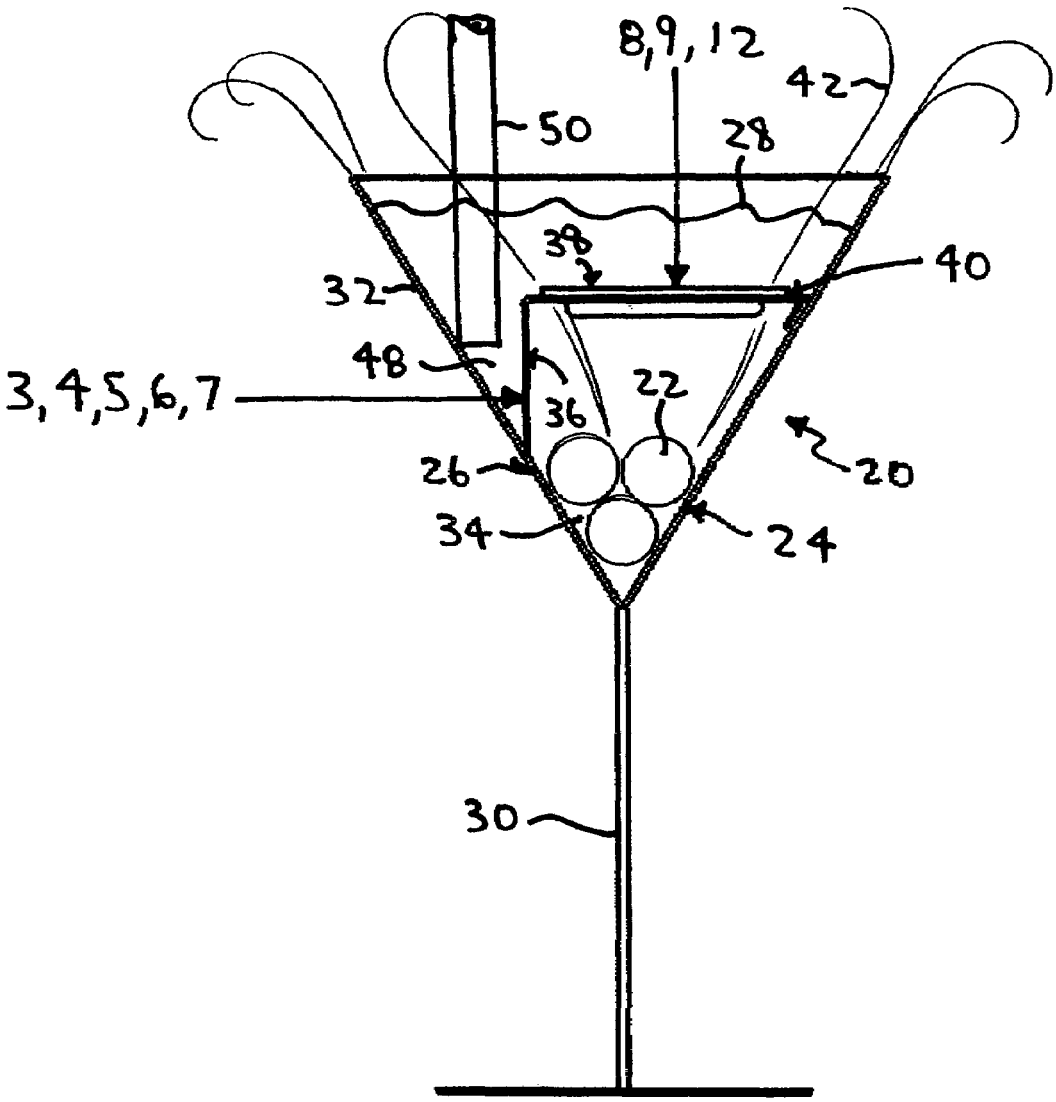
FIG. 2 is a diagrammatic side elevational view taken generally in the direction of ARROW 2 in FIG. 1.

Referring now to the figures, in which like numerals indicate like parts, and particularly to FIGS. 1 and 2, which are, respectively, a diagrammatic perspective view of the novelty enclosure of the present invention trapping dry ice in a drinking glass, and, a diagrammatic side elevational view taken generally in the direction of ARROW 2 in FIG. 1, the novelty enclosure of the present invention is shown generally at 20 for trapping dry ice 22 in a drinking glass 24. The drinking glass 24 includes a bowl 26 for containing a drink 28 and an optional stem 30 depending from the bowl 26 of the drinking glass 24. The bowl 26 of the drinking glass 24 has a side wall 32 and a bottom 34.

The novelty enclosure 20 comprises a fixed portion 36, a replaceable portion 38, and apparatus 40. The fixed portion 36 is for positioning within—and attaching to—the bowl 26 of the drinking glass 24, and for trapping the dry ice 22. The fixed portion 36 is for attaching to the bowl 26 of the drinking glass 24 by any known ways, such as, but not limited to, an adhesive, a groove, etc. The replaceable portion 38 is replaceably attached to the fixed portion 36, and is for allowing the fixed portion 36 to be filled with the dry ice 22. The replaceable portion 38 is replaceably attached to the fixed portion 36 by a press fit, screwing, etc. The apparatus 40 is for allowing at least one of the fixed portion 36 and the replaceable portion 38 to permit vapor 42 caused by sublimating the dry ice 22 to rise there through and up through and out of the drink 28 giving an illusion of a witches brew. A primary function of the sublimating of the dry ice 22 is to cool the drink, while a secondary function is to create the illusion of the witches brew.

It is to be understood that the dry ice 22 is the preferred solid because it cools the drink 28 and creates the illusion of the witches brew, but it is not limited to that, and can be for all intent and purposes any solid if so desired by a user for other purposes.

B. First Embodiment of the Apparatus 140

Figure 3:
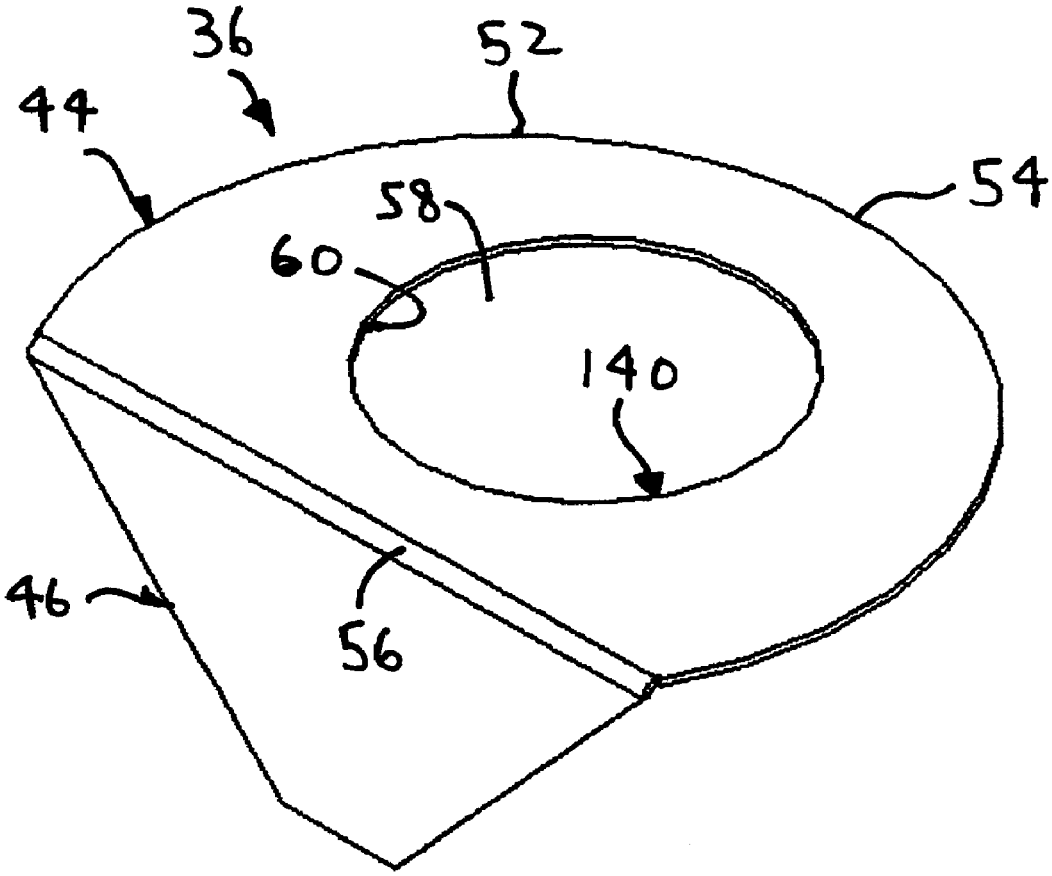
FIG. 3 is an enlarged diagrammatic perspective view of the fixed portion of the novelty enclosure of the present invention—identified by ARROW 3 in FIGS. 1 and 2—and a first embodiment of the apparatus of the novelty enclosure of the present invention.

The configuration of the fixed portion 36 and a first embodiment of the apparatus 140 can best be seen in FIG. 3, which is an enlarged diagrammatic perspective view of the fixed portion of the novelty enclosure of the present invention—identified by ARROW 3 in FIGS. 1 and 2—and a first embodiment of the apparatus of the novelty enclosure of the present invention, and as such, will be discussed with reference thereto.

The fixed portion 36 comprises a top part 44 and a side part 46. The top part 44 of the fixed portion 36 is for extending transversely across the side wall 32 of the bowl 26 of the drinking glass 24. The side part 46 of the fixed portion 36 depends from the top part 44 of the fixed portion 36, and is for extending laterally across the side wall 32 of the bowl 26 of the drinking glass 24 and downwardly to the bottom 34 of the bowl 26 of the drinking glass 24—and in doing so—together with the top part 44 of the fixed portion 36—traps the dry ice 22 to one side of the side part 46 of the fixed portion 36 without obstructing the bowl 26 of the drinking glass 24 to the other side of the side part 46 of the fixed portion 36 so as to provide an unobstructed portion 48 in the bowl 26 of the drinking glass 24—opposite to the top part 44 of the fixed portion 36—for placement of an item, for example, a straw 50, a toothpick/olive, etc. See FIG. 2.

The top part 44 of the fixed portion 36 is more horizontal than vertical—and is preferably planar—but is not limited to that, while the side part 46 of the fixed portion 36 is more vertical than horizontal—and is preferably planar—but is not limited to that.

The top part 44 of the fixed portion 36 has a periphery 52. The periphery 52 of the top part 44 of the fixed portion 36 has an outer portion 54 and an inner portion 56. The outer portion 54 of the periphery 52 of the top part 44 of the fixed portion 36 is for contacting the side wall 32 of the bowl 26 of the drinking glass 24. The inner portion 56 of the periphery 52 of the top part 44 of the fixed portion 36 has the side part 46 of the fixed portion 36 depending therefrom, and is for being spaced from the side wall 32 of the bowl 26 of the drinking glass 24 so as to provide the unobstructed portion 48 in the bowl 26 of the drinking glass 24.

The top part 44 of the fixed portion 36 has a through bore 58 there through. The through bore 58 in the top part 44 of the fixed portion 36 has a periphery 60, is for allowing the fixed portion 36 to be filled with the dry ice 22, and is selectively closed by the replaceable portion 38.

The apparatus 140 comprises the periphery 60 of the through bore 58 in the top part 44 of the fixed portion 36 being slightly larger than a portion of the replaceable portion 38 for allowing the vapor 42 from the dry ice 22 to rise there between and up through and out of the drink 28 giving an illusion of a witches brew, and cooling and mixing the drink 24.

C. Second Embodiment of the Apparatus 240

Figure 4:
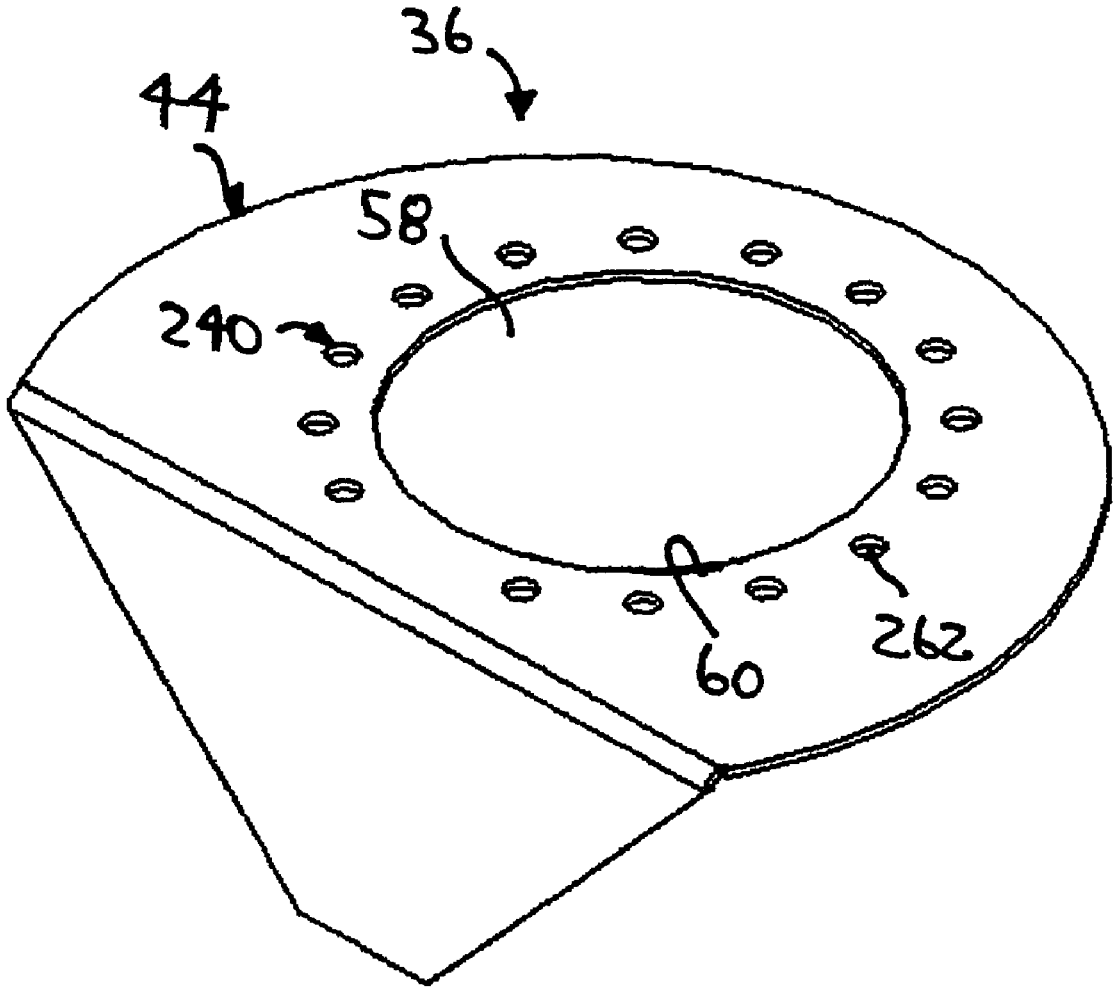
FIG. 4 is an enlarged diagrammatic perspective view of the fixed portion of the novelty enclosure of the present invention—identified by ARROW 4 in FIGS. 1 and 2—and a second embodiment of the apparatus of the novelty enclosure of the present invention.

The configuration of a second embodiment of the apparatus 240 can best be seen in FIG. 4, which is an enlarged diagrammatic perspective view of the fixed portion of the novelty enclosure of the present invention—identified by ARROW 4 in FIGS. 1 and 2—and a second embodiment of the apparatus of the novelty enclosure of the present invention, and as such, will be discussed with reference thereto.

The apparatus 240 comprises the top part 44 of the fixed portion 36 having a plurality of through bores 262. The plurality of through bores 262 in the top part 44 of the fixed portion 36 extend around the periphery 60 of the through bore 58 in the top part 44 of the fixed portion 36, and are for allowing the vapor 42 from the dry ice 22 to rise there through and up through and out of the drink 28 giving an illusion of a witches brew, and cooling and mixing the drink 24.

D. Third Embodiment of the Apparatus 340

Figure 5:
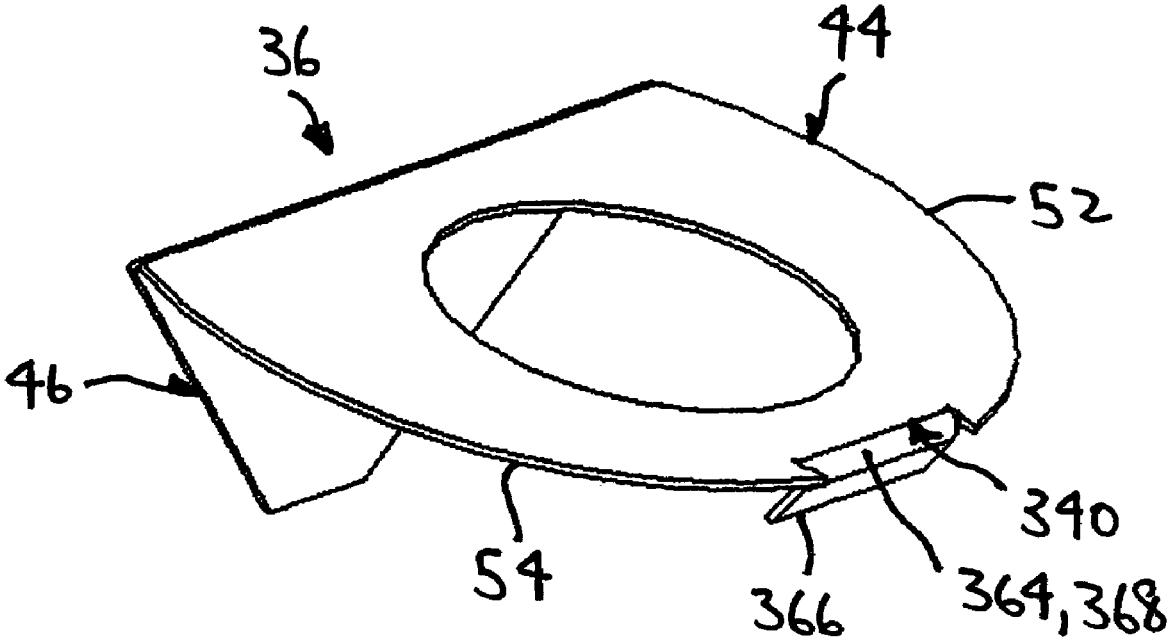
FIG. 5 is an enlarged diagrammatic perspective view of the fixed portion of the novelty enclosure of the present invention—identified by ARROW 5 in FIGS. 1 and 2—and a third embodiment of the apparatus of the novelty enclosure of the present.

The configuration of a third embodiment of the apparatus 340 can best be seen in FIG. 5, which is an enlarged diagrammatic perspective view of the fixed portion of the novelty enclosure of the present invention—identified by ARROW 5 in FIGS. 1 and 2—and a third embodiment of the apparatus of the novelty enclosure of the present invention, and as such, will be discussed with reference thereto.

The apparatus 340 comprises the outer portion 54 of the periphery 52 of the top part 44 of the fixed portion 36 having a recess 364 therein with a depending tab 366. The recess 364 in the outer portion 54 of the periphery 52 of the top part 44 of the fixed portion 36 is for providing a space 368 between the outer portion 54 of the periphery 52 of the top part 44 of the fixed portion 36 and the side wall 32 of the bowl 26 of the drinking glass 24 for allowing the vapor 42 from the dry ice 22 to rise there through and up through and out of the drink 28 giving an illusion of a witches brew, and for drainage of debris contained in the fixed portion 36.

The tab 366 of the outer portion 54 of the periphery 52 of the top part 44 of the fixed portion 36 prevents the dry ice 22 from spilling out of the space 368 in the outer portion 54 of the periphery 52 of the top part 44 of the fixed portion 36 when the drink 28 is drunk from that side of the drinking glass 24.

The recess 364 in the outer portion 54 of the periphery 52 of the top part 44 of the fixed portion 36 is preferably diametrically opposed to the side part 46 of the fixed portion 36—but is not limited to that.

E. Fourth Embodiment of the Apparatus 440

Figure 6:
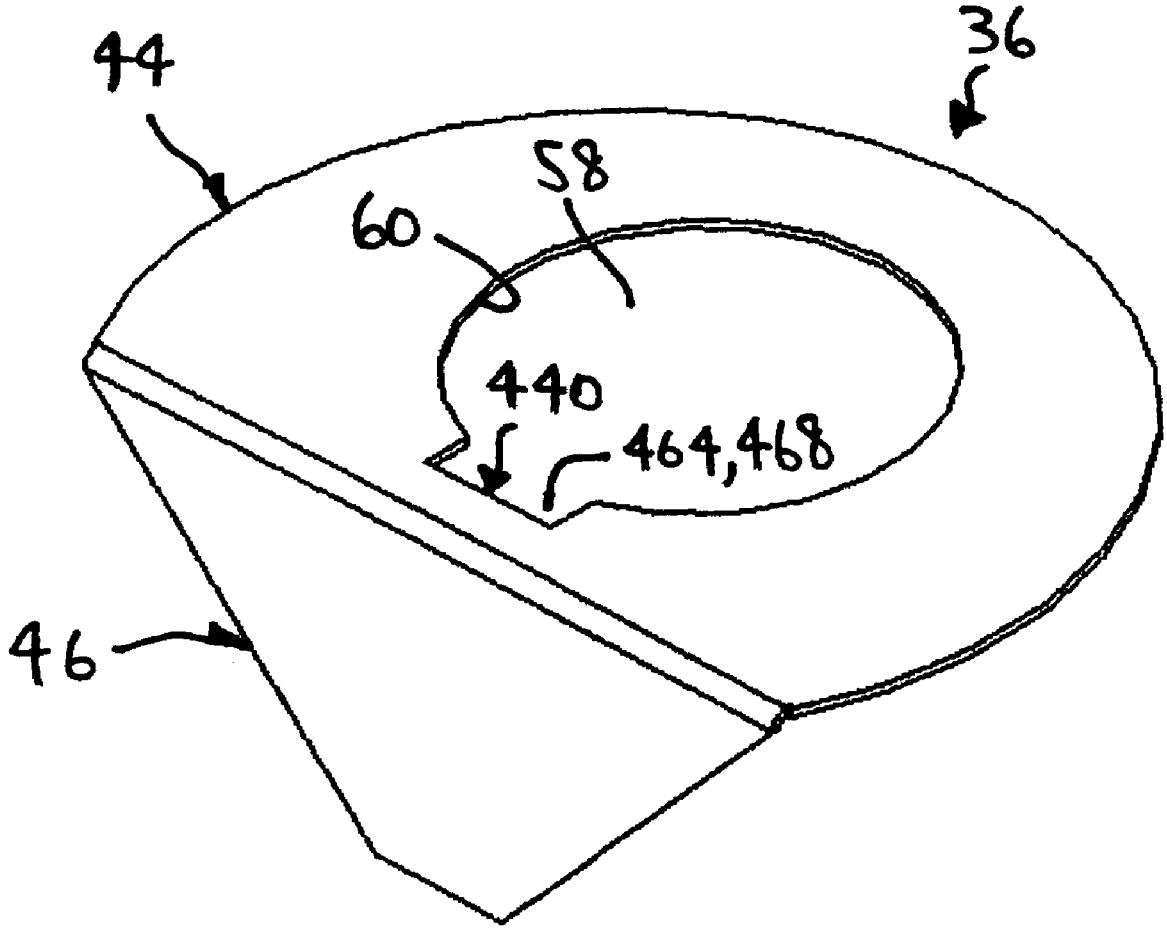
FIG. 6 is an enlarged diagrammatic perspective view of the fixed portion of the novelty enclosure of the present invention—identified by ARROW 6 in FIGS. 1 and 2—and a fourth embodiment of the apparatus of the novelty enclosure of the present invention.

The configuration of a fourth embodiment of the apparatus 440 can best be seen in FIG. 6, which is an enlarged diagrammatic perspective view of the fixed portion of the novelty enclosure of the present invention—identified by ARROW 6 in FIGS. 1 and 2—and a fourth embodiment of the apparatus of the novelty enclosure of the present invention, and as such, will be discussed with reference thereto.

The apparatus 440 comprises the periphery 60 of the through bore 58 in the top part 44 of the fixed portion 36 having a recess 464 therein. The recess 464 in the periphery 60 of the through bore 58 in the top part 44 of the fixed portion 36 provides a space 468 between the top part 44 of the fixed portion 36 and the replaceable portion 38 for allowing the vapor 42 from the dry ice 22 to rise there through and up through and out of the drink 28 giving an illusion of a witches brew, and for prying out of removable portion 38.

The recess 464 in the periphery 60 of the through bore 58 in the top part 44 of the fixed portion 36 is preferably adjacent the side part 46 of the fixed portion 36—but is not limited to that.

F. Fifth Embodiment of the Apparatus 540

Figure 7:
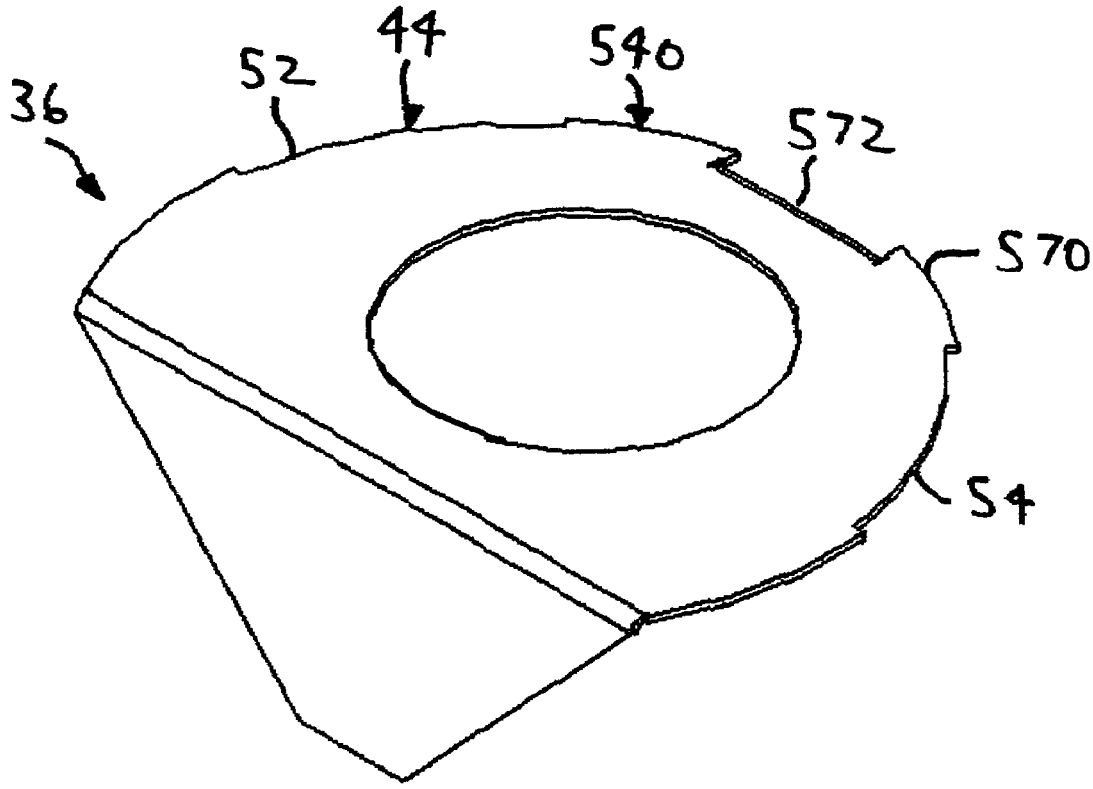
FIG. 7 is an enlarged diagrammatic perspective view of the fixed portion of the novelty enclosure of the present invention—identified by ARROW 7 in FIGS. 1 and 2—and a fifth embodiment of the apparatus of the novelty enclosure of the present invention.

The configuration of a fifth embodiment of the apparatus 540 can best be seen in FIG. 7, which is an enlarged diagrammatic perspective view of the fixed portion of the novelty enclosure of the present invention—identified by ARROW 7 in FIGS. 1 and 2—and a fifth embodiment of the apparatus of the novelty enclosure of the present invention, and as such, will be discussed with reference thereto.

The apparatus 540 comprises the outer portion 54 of the periphery 52 of the top part 44 of the fixed portion 36 having a plurality of tabs 570 extending therefrom—preferably coplanarly. The plurality of tabs 570 of the outer portion 54 of the periphery 52 of the top part 44 of the fixed portion 36 are for attaching to bowl 26 of drinking glass 24, and form a plurality of spaces 572 there between and between the outer portion 54 of the periphery 52 of the top part 44 of the fixed portion 36 and the side wall 32 of the bowl 26 of the drinking glass 24 for allowing the vapor 42 from the dry ice 22 to rise there through and up through and out of the drink 28 giving an illusion of a witches brew.

G. Sixth Embodiment of the Apparatus 640

Figure 8:
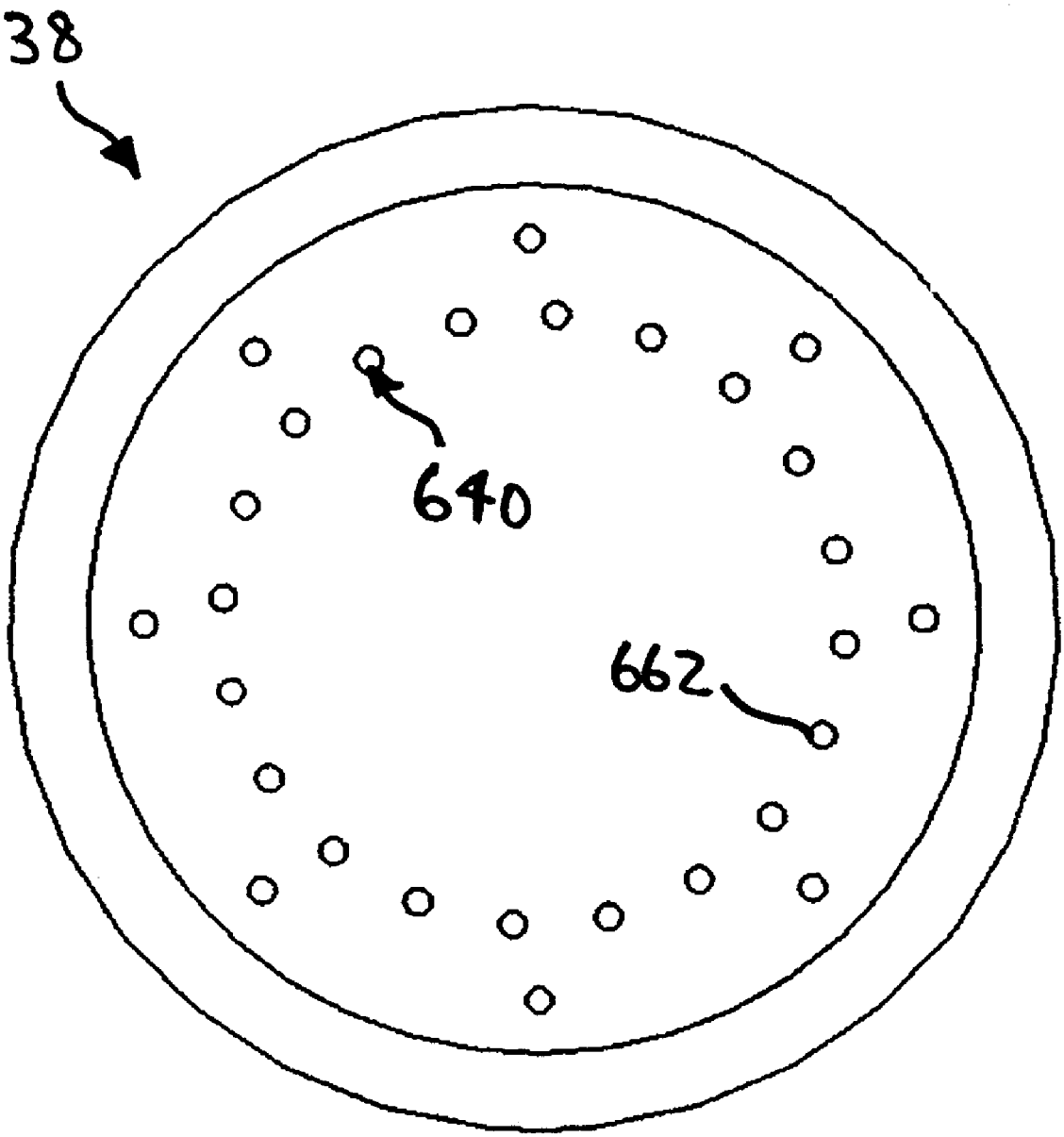
FIG. 8 is an enlarged diagrammatic top plan view of the replaceable portion of the novelty enclosure of the present invention—identified by ARROW 8 in FIGS. 1 and 2—and a sixth embodiment of the apparatus of the novelty enclosure of the present invention.

The configuration of a sixth embodiment of the apparatus 640 can best be seen in FIG. 8, which is an enlarged diagrammatic top plan view of the replaceable portion of the novelty enclosure of the present invention—identified by ARROW 8 in FIGS. 1 and 2—and a sixth embodiment of the apparatus of the novelty enclosure of the present invention, and as such, will be discussed with reference thereto.

The apparatus 640 comprises the replaceable portion 38 having a plurality of through bores 662 there through. The plurality of through bores 662 in the replaceable portion 38 are for allowing the vapor 42 from the dry ice 22 to rise there through and up through and out of the drink 28 giving an illusion of a witches brew, and cooling and mixing the drink 24.

H. First Embodiment of the Replaceable Portion 138

Figure 9:
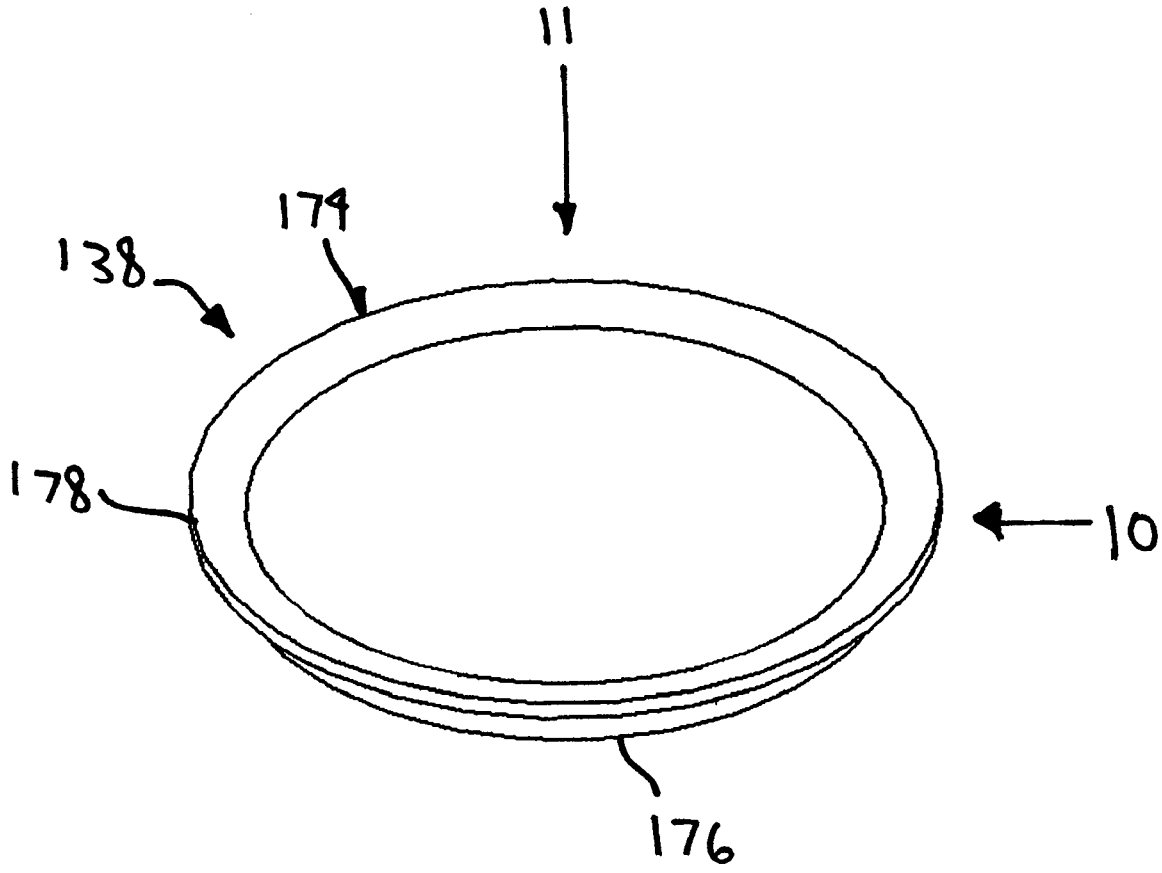
FIG. 9 is an enlarged diagrammatic perspective view of a first embodiment of the replaceable portion of the novelty enclosure of the present invention, identified by ARROW 9 in FIGS. 1 and 2.
Figure 10:
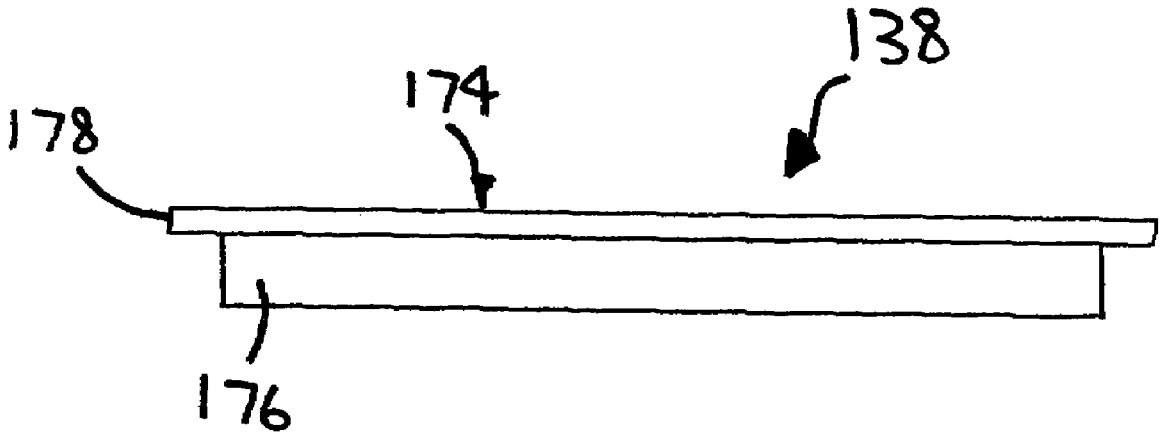
FIG. 10 is a diagrammatic side elevational view taken generally in the direction of ARROW 10 in FIG. 9.
Figure 11:
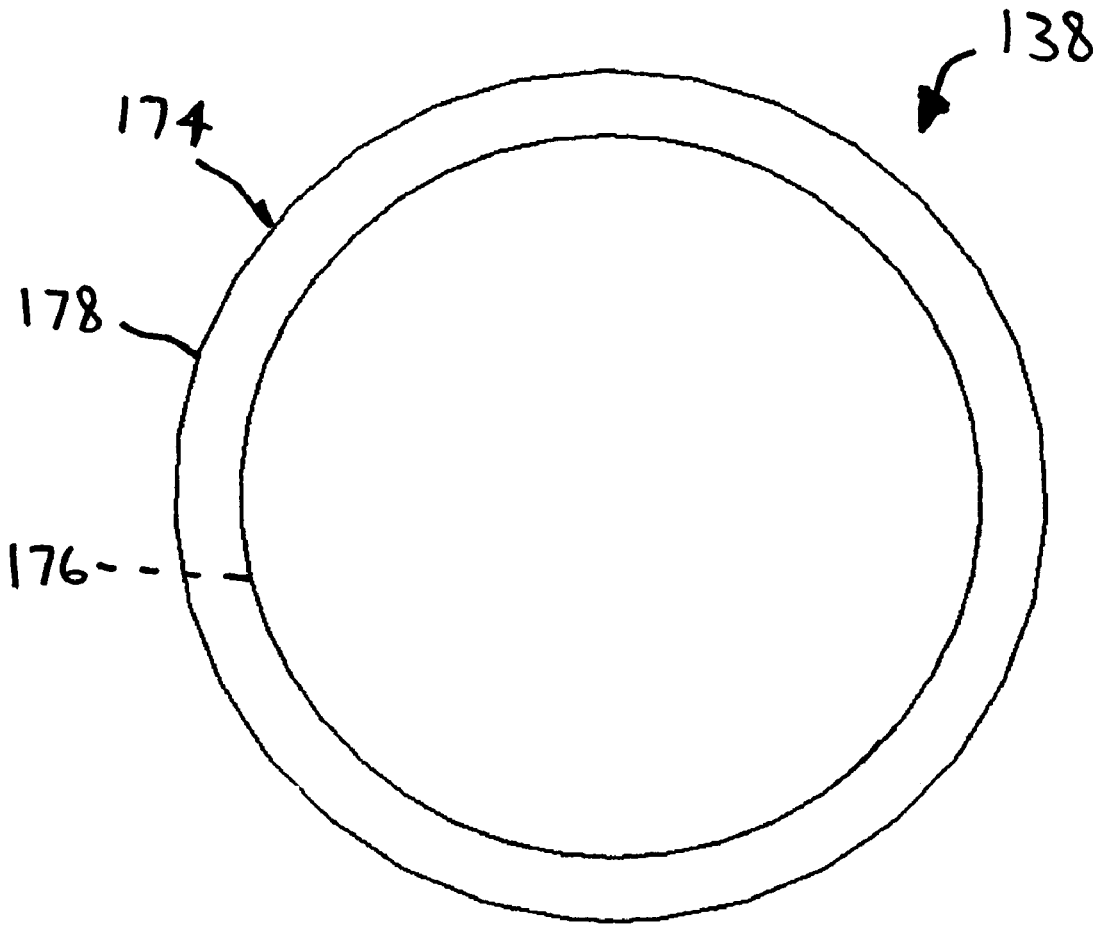
FIG. 11 is a diagrammatic top plan view taken generally in the direction of ARROW 11 in FIG. 9.

The configuration of a first embodiment of the replaceable portion 138 can best be seen in FIGS. 9-11, which are, respectively, an enlarged diagrammatic perspective view of a first embodiment of the replaceable portion of the novelty enclosure of the present invention, identified by ARROW 9 in FIGS. 1 and 2, a diagrammatic side elevational view taken generally in the direction of ARROW 10 in FIG. 9, and, a diagrammatic top plan view taken generally in the direction of ARROW 11 in FIG. 9, and as such, will be discussed with reference thereto.

The replaceable portion 138 is a cap 174. The cap 174 of the replaceable portion 138 selectively opens and closes the through bore 58 in the top part 44 of the fixed portion 36.

The cap 174 of the replaceable portion 138 comprises a body 176 and an upper flange 178. The body 176 of the cap 174 of the replaceable portion 138 is so shaped and sized so as to fit loosely in the through bore 58 in the top part 44 of the fixed portion 36 for allowing the vapor 42 from the dry ice 22 to rise there between and up through and out of the drink 28 giving an illusion of a witches brew, and preventing the dry ice 22 from spilling out and being consumed.

The upper flange 178 of the cap 174 of the replaceable portion 138 extends circumferentially around the body 176 of the cap 174 of the replaceable portion 138, and rests on the top part 44 of the fixed portion 36 so as to prevent the cap 174 of the replaceable portion 138 from falling through the through bore 58 in the top part 44 of the fixed portion 36.

I. Second Embodiment of the Replaceable Portion 238

Figure 12:
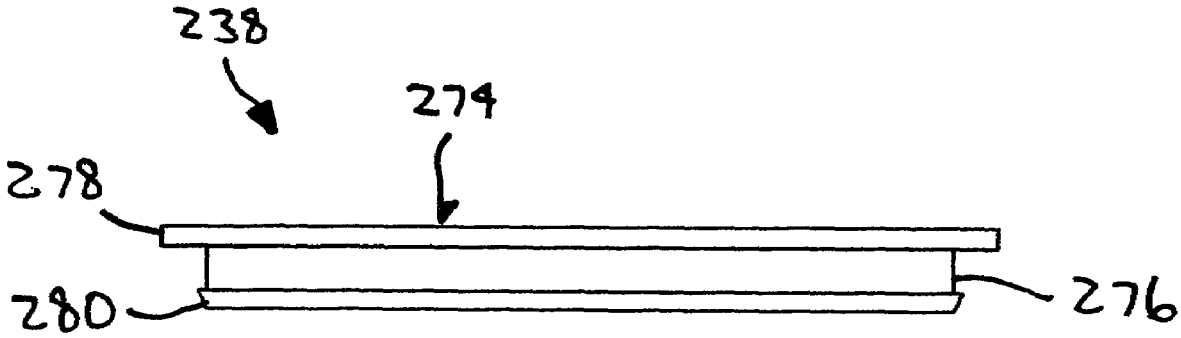
FIG. 12 is an enlarged diagrammatic side elevational view of a second embodiment of the replaceable portion of the novelty enclosure of the present invention, identified by ARROW 12 in FIGS. 1 and 2.

The configuration of a second embodiment of the replaceable portion 238 can best be seen in FIG. 12—which is an enlarged diagrammatic side elevational view of a second embodiment of the replaceable portion of the novelty enclosure of the present invention, identified by ARROW 12 in FIGS. 1 and 2—and as such—will be discussed with reference thereto.

The replaceable portion 238 is a cap 274. The cap 274 of the replaceable portion 238 selectively opens and closes the through bore 58 in the top part 44 of the fixed portion 36.

The cap 274 of the replaceable portion 238 comprises a body 276, an upper flange 278, and a lower flange 280. The body 276 of the cap 274 of the replaceable portion 238 is shaped and sized to fit in the through bore 58 in the top part 44 of the fixed portion 36.

The upper flange 278 of the cap 274 of the replaceable portion 238 extends circumferentially around the body 276 of the cap 274 of the replaceable portion 238, and rests on the top part 44 of the fixed portion 36 preventing the cap 274 of the replaceable portion 238 from falling through the through bore 58 in the top part 44 of the fixed portion 36.

The lower flange 280 of the cap 274 of the replaceable portion 238 extends circumferentially around the body 274 of the cap 274 of the replaceable portion 238, is positioned below the upper flange 278 of the cap 274 of the replaceable portion 238, and sandwiches the top part 44 of the fixed portion 36 between itself and the upper flange 278 of the cap 274 of the replaceable portion 238, thereby providing a snug fit for the cap 274 of the replaceable portion 238.

It will be understood that each of the elements described above, or two or more together, may also find a useful application in other types of constructions differing from the types described above.

While the invention has been illustrated and described as embodied in a novelty enclosure for trapping dry ice in a drinking glass, however, it is not limited to the details shown, since it will be understood that various omissions, modifications, substitutions and changes in the forms and details of the assembly illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. A novelty enclosure for trapping dry ice in a drinking glass, wherein the drinking glass includes a bowl for containing a drink, and wherein the bowl of the drinking glass has a side wall and a bottom, said enclosure comprising:

a) a fixed portion;

b) a replaceable portion; and c) means for allowing at least one of said fixed portion and said replaceable portion to permit vapor from the dry ice to rise there through and up through and out of the drink giving an illusion of a witches brew;

wherein said fixed portion is for positioning within the bowl of the drinking glass;

wherein said fixed portion is for attaching to the bowl of the drinking glass;

wherein said fixed portion is for trapping the dry ice;

wherein said replaceable portion is replaceably attached to said fixed portion; and wherein said replaceable portion is for allowing said fixed portion to be filled with the dry ice.

2. The enclosure of claim 1, wherein said fixed portion comprises a top part;

wherein said fixed portion comprises a side part;

wherein said top part of said fixed portion is for extending transversely across the side wall of the bowl of the drinking glass;

wherein said side part of said fixed portion depends from said top part of said fixed portion; and wherein said side part of said fixed portion is for extending laterally across the side wall of the bowl of the drinking glass and downwardly to the bottom of the bowl of the drinking glass, and in doing so, together with said top part of said fixed portion, traps the dry ice to one side of said side part of said fixed portion without obstructing the bowl of the drinking glass to the other side of said side part of said fixed portion so as to provide an unobstructed portion in the bowl of the drinking glass, opposite to said top part of said fixed portion, for placement of an item.

3. The enclosure of claim 2, wherein said top part of said fixed portion is more horizontal than vertical; and wherein said side part of said fixed portion is more vertical than horizontal.

4. The enclosure of claim 2, wherein said top part of said fixed portion is planar; and wherein said side part of said fixed portion is planar.

5. The enclosure of claim 2, wherein said top part of said fixed portion has a periphery;

wherein said periphery of said top part of said fixed portion has an outer portion;

wherein said periphery of said top part of said fixed portion has an inner portion;

wherein said outer portion of said periphery of said top part of said fixed portion is for contacting the side wall of the bowl of the drinking glass;

wherein said inner portion of said periphery of said top part of said fixed portion has said side part of said fixed portion depending therefrom; and wherein said inner portion of said periphery of said top part of said fixed portion is for being spaced from the side wall of the bowl of the drinking glass so as to provide the unobstructed portion in the bowl of the drinking glass.

6. The enclosure of claim 2, wherein said top part of said fixed portion has a through bore there through;

wherein said through bore in said top part of said fixed portion has a periphery;

wherein said through bore in said top part of said fixed portion is for allowing said fixed portion to be filled with the dry ice; and wherein said through bore in said top part of said fixed portion is selectively closed by said replaceable portion.

7. The enclosure of claim 6, wherein said means includes said periphery of said through bore in said top part of said fixed portion being slightly larger than a portion of said replaceable portion for allowing the vapor from the dry ice to rise there between and up through and out of the drink giving an illusion of a witches brew.

8. The enclosure of claim 6, wherein said means includes said top part of said fixed portion having a plurality of through bores there through.

9. The enclosure of claim 8, wherein said plurality of through bores in said top part of said fixed portion extend around said periphery of said through bore in said top part of said fixed portion; and wherein said plurality of through bores in said top part of said fixed portion are for allowing the vapor from the dry ice to rise there through and up through and out of the drink giving an illusion of a witches brew.

10. The enclosure of claim 5, wherein said means includes said outer portion of said periphery of said top part of said fixed portion having a recess therein;

wherein said recess in said outer portion of said periphery of said top part of said fixed portion is for providing a space between said outer portion of said periphery of said top part of said fixed portion and the side wall of the bowl of the drinking glass; and wherein said space is for allowing the vapor from the dry ice to rise there through and up through and out of the drink giving an illusion of a witches brew.

11. The enclosure of claim 10, wherein said recess in said outer portion of said periphery of said top part of said fixed portion is diametrically opposed to said side part of said fixed portion.

12. The enclosure of claim 6, wherein said means includes said periphery of said through bore in said top part of said fixed portion having a recess therein;

wherein said recess in said periphery of said through bore in said top part of said fixed portion provides a space between said top part of said fixed portion and said replaceable portion; and wherein said space is for allowing the vapor from the dry ice to rise there through and up through and out of the drink giving an illusion of a witches brew.

13. The enclosure of claim 12, wherein said recess in said periphery of said through bore in said top part of said fixed portion is adjacent said side part of said fixed portion.

14. The enclosure of claim 5, wherein said means includes said outer portion of said periphery of said top part of said fixed portion having a plurality of tabs extending therefrom;

wherein said plurality of tabs of said outer portion of said periphery of said top part of said fixed portion form a plurality of spaces there between and between said outer portion of said periphery of said top part of said fixed portion and the side wall of the bowl of the drinking glass; and wherein said plurality of spaces are for allowing the vapor from the dry ice to rise there through and up through and out of the drink giving an illusion of a witches brew.

15. The enclosure of claim 14, wherein said plurality of tabs extend coplanarly from said outer portion of said periphery of said top part of said fixed portion.

16. The enclosure of claim 1, wherein said means includes said replaceable portion having a plurality of through bores there through; and wherein said plurality of through bores in said replaceable portion are for allowing the vapor from the dry ice to rise there through and up through and out of the drink giving an illusion of a witches brew.

17. The enclosure of claim 6, wherein said replaceable portion is a cap; and wherein said cap of said replaceable portion selectively opens and closes said through bore in said top part of said fixed portion.

18. The enclosure of claim 17, wherein said cap of said replaceable portion comprises a body; and wherein said cap of said replaceable portion comprises an upper flange.

19. The enclosure of claim 18, wherein said body of said cap of said replaceable portion is so shaped and sized so as to fit loosely in said through bore in said top part of said fixed portion for allowing the vapor from the dry ice to rise there between and up through and out of the drink giving an illusion of a witches brew.

20. The enclosure of claim 18, wherein said upper flange of said cap of said replaceable portion extends circumferentially around said body of said cap of said replaceable portion; and wherein said upper flange of said cap of said replaceable portion rests on said top part of said fixed portion so as to prevent said cap of said replaceable portion from falling through said through bore in said top part of said fixed portion.

21. The enclosure of claim 18, wherein said cap of said replaceable portion comprises a lower flange;

wherein said lower flange of said cap of said replaceable portion extends circumferentially around said body of said cap of said replaceable portion; and wherein said lower flange of said cap of said replaceable portion is positioned below said upper flange of said cap of said replaceable portion so as to sandwich said top part of said fixed portion between itself and said upper flange of said cap of said replaceable portion, thereby providing a snug fit for said cap of said replaceable portion.

* * * * *